US009010439B2

(12) United States Patent
Fogg et al.

(10) Patent No.: US 9,010,439 B2
(45) Date of Patent: Apr. 21, 2015

(54) UMBILICAL

(75) Inventors: David Fogg, Newcastle Upon Tyne (GB); Xiaoxue An, Newcastle Upon Tyne (GB); Dave Bromfield, Whitley Bay (GB); Alan Dobson, Newcastle Upon Tyne (GB)

(73) Assignee: Technip France (FR)

( * ) Notice: Subject to any disclaimer, the term of this patent is extended or adjusted under 35 U.S.C. 154(b) by 0 days.

(21) Appl. No.: 13/640,437

(22) PCT Filed: Apr. 14, 2011

(86) PCT No.: PCT/GB2011/050740

§ 371 (c)(1),
(2), (4) Date: Nov. 14, 2012

(87) PCT Pub. No.: WO2011/131968

PCT Pub. Date: Oct. 27, 2011

(65) Prior Publication Data

US 2013/0051740 A1 Feb. 28, 2013

(30) Foreign Application Priority Data

Apr. 19, 2010 (GB) ..... 1006460.8

(51) Int. Cl.
*E21B 17/01* (2006.01)
*H01B 7/04* (2006.01)

(52) U.S. Cl.
CPC ..... *H01B 7/045* (2013.01)

(58) Field of Classification Search
USPC ..... 166/367, 344, 346, 351, 352; 138/111, 138/112, 114; 405/169, 224.3
See application file for complete search history.

(56) References Cited

U.S. PATENT DOCUMENTS 4,196,307 A * 4/1980 Moore et al. ..... 174/47
4,569,392 A * 2/1986 Peterman ..... 166/65.1
4,684,427 A * 8/1987 Abernathy ..... 156/244.12
6,283,206 B1 * 9/2001 Fraser et al. ..... 166/242.3
6,472,614 B1 * 10/2002 Dupont et al. ..... 174/70 S (Continued)

FOREIGN PATENT DOCUMENTS

EP 1 691 378 A2 8/2006
GB 2 230 091 A 10/1990

(Continued)

OTHER PUBLICATIONS

International Preliminary Report on Patentability and Written Opinion of the International Searching Authority with a mailing date of Oct. 23, 2012 issued in corresponding International Application No. PCT/GB2011/050740 (6 pages).
Search Report dated Jul. 7, 2010 issued in corresponding Great Britain Patent Application No. GB1006460.8 (1 page).

(Continued)

*Primary Examiner* — Matthew Buck
(74) *Attorney, Agent, or Firm* — Ostrolenk Faber LLP

(57) ABSTRACT

An umbilical for use in the offshore production of hydrocarbons, and in particular to a power umbilical for use in deep water applications is described, comprising a plurality of longitudinal strength members, wherein at least one longitudinal strength member comprises rope enclosed within a tube. In this way, the or each longitudinal strength member being a rope and tube combination achieves the synergistic benefit of favorable mechanical properties in the axial direction, with favorable mechanical properties in the radial direction during tensioning or the like of the umbilical, especially during installation.

10 Claims, 2 Drawing Sheets

(56) References Cited

U.S. PATENT DOCUMENTS

| | | | | |
|---|---|---|---|---|
| 6,493,491 | B1 | 12/2002 | Shen et al. | |
| 6,612,370 | B1 * | 9/2003 | Jahnsen et al. | 166/367 |
| 7,158,703 | B2 * | 1/2007 | Mjelstad | 385/101 |
| 7,754,966 | B2 * | 7/2010 | Figenschou | 174/47 |
| 2006/0193572 | A1 * | 8/2006 | Mjelstad | 385/101 |
| 2007/0205009 | A1 * | 9/2007 | Figenschou | 174/47 |
| 2007/0251694 | A1 * | 11/2007 | Ju et al. | 166/345 |
| 2007/0253778 | A1 * | 11/2007 | Figenschou | 405/169 |
| 2010/0243289 | A1 * | 9/2010 | Figenschou | 174/47 |
| 2012/0234578 | A1 * | 9/2012 | Figenschou | 174/116 |

FOREIGN PATENT DOCUMENTS

| | | | |
|---|---|---|---|
| GB | 2 316 990 | | 3/1998 |
| GB | 2 326 177 | | 12/1998 |
| WO | WO 93/17176 | | 9/1993 |
| WO | WO 2004/071865 | A2 | 8/2004 |
| WO | WO 2004/077440 | A1 | 9/2004 |
| WO | WO 2005/124095 | | 12/2005 |

OTHER PUBLICATIONS

International Search Report dated Dec. 12, 2011 issued in corresponding international application No. PCT/GB2011/050740.

* cited by examiner

UMBILICAL

CROSS REFERENCE TO RELATED APPLICATIONS

The present application is a 35 U.S.C. §371 National Phase conversion of PCT/GB2011/050740, filed Apr. 14, 2011, which claims benefit of British Application No. 1006460.8, filed Apr. 19, 2010, the disclosure of which is incorporated herein by reference. The PCT International Application was published in the English language.

TECHNICAL FIELD OF THE INVENTION

The present invention relates to an umbilical for use in the offshore production of hydrocarbons, and in particular to a power umbilical for use in deep water applications.

BACKGROUND OF THE INVENTION

An umbilical consists of a group of one or more types of elongated or longitudinal active umbilical elements, such as electrical cables, optical fibre cables, steel tubes and/or hoses, cabled together for flexibility, over-sheathed and, when applicable, armoured for mechanical strength. Umbilicals are typically used for transmitting power, signals and fluids (for example for fluid injection, hydraulic power, gas release, etc.) to and from a subsea installation.

The umbilical cross-section is generally circular, the elongated elements being wound together either in a helical or in a S/Z pattern. In order to fill the interstitial voids between the various umbilical elements and obtain the desired configuration, filler components may be included within the voids.

ISO 13628-5/API 17E "Specification for Subsea Umbilicals" provides standards for the design and manufacture of such umbilicals.

Subsea umbilicals are installed at increasing water depths, commonly deeper than 2000 m. Such umbilicals have to be able to withstand severe loading conditions during their installation and their service life.

The main load bearing components in charge of withstanding the axial loads due to the weight (tension) and to the movements (bending stresses) of the umbilical are: steels tubes (see for example U.S. Pat. No. 6,472,614, WO93/17176, GB2316990), steel rods (U.S. Pat. No. 6,472,614), composite rods (WO2005/124095, US2007/0251694), steel ropes (GB2326177, WO2005/124095), or tensile armour layers (see FIG. 1 of U.S. Pat. No. 6,472,614).

The other elements, such as the electrical and optical cables, the thermoplastic hoses, the polymeric external sheath and the polymeric filler components, do not contribute significantly to the tensile strength of the umbilical.

The load bearing components of most umbilicals are made of steel, which adds strength but also weight to the structure. As the water depth increases, the suspended weight also increases (for example in a riser configuration) until a limit is reached at which the umbilical is not able to support its own suspended weight. This limit depends on the structure and on the dynamic conditions at the (water) surface or 'topside'. This limit is around 3000 m for steel reinforced dynamic power umbilicals (i.e. umbilical risers comprising large and heavy electrical power cables with copper conductors).

However, it is desired to create power umbilicals for ultra-deep water (such as depth (D)>3000 m). Such umbilicals comprise very heavy copper conductor cables and must be strongly reinforced to be able to withstand their beyond-normal suspended weight and the dynamic installation and operating loads.

An easy solution would be to reinforce such umbilicals with further steel load bearing strength members, such as the rods, wires, tubes or ropes described above. However, due to the important specific gravity of steel, this solution now also adds a significant weight to the umbilical and does not solve the problem in considerable extended lengths. For example, in static conditions, the water depth limit of such a solution is around D=3200 m, where the maximum tensile stress in the copper conductors of the power cables (being weak point of the structure) reaches its yield point (at the topside area close to the surface). However, in any dynamic conditions, this depth limit is naturally lower because of the fatigue phenomenon. Furthermore, such steel reinforced umbilicals are very heavy and require evermore powerful and expensive installation vessels.

A suggested solution to this problem consists in using composite material strength members shown in WO2005/124095 and US2007/0251694. However, such umbilicals are difficult to manufacture and so are very expensive.

An object of the present invention is to overcome one or more of the above limitations and to provide an umbilical which can be used at greater water depths (up to 3000 m and more) and/or under greater or more severe dynamic loading.

SUMMARY OF THE INVENTION

According to one aspect of the present invention, there is provided an umbilical comprising a plurality of longitudinal strength members, wherein at least one longitudinal strength member comprises rope enclosed within a tube.

In this way, the or each longitudinal strength member being a rope and tube combination achieves the synergistic benefit of favourable mechanical properties in the axial direction, with favourable mechanical properties in the radial direction during tensioning or the like of the umbilical, especially during installation.

Preferably, the or each longitudinal strength member comprising rope enclosed within a tube extends wholly or substantially the length of the umbilical, more preferably as a continuous and non-changing strength member.

Such strength member(s) of the present invention provide at least some, optionally all, of the load bearing of the umbilical in use, and are generally formed as windings in the umbilical along with the other umbilical elements, generally not being the core of the umbilical.

In one embodiment of the present invention, the rope is made of any suitable high strength low density material. The tensile strength of the rope is preferably higher than 2000 MPa, more preferably higher than 3000 MPa. The strength to weight ratio of the rope is preferably higher than $0.6\times10^6$ Nm/kg, more preferably higher than $1.0\times10^6$ Nm/kg.

In another embodiment of the present invention, the rope comprises one or more of the materials of the group comprising: high strength steel, titanium alloys, steel cord, glass fibre, ceramic fibre, carbon fibre, boron fibre, aromatic polyester fibre, aromatic polyamide (aramid) fibre, liquid crystal fibre, high performance polyethylene fibre, liquid crystal fibre and aromatic heterocyclic polymer fibre (PBO).

One particular aromatic heterocyclic polymer fibre (PBO) is Zylon® fibre. The Zylon® fibre is a trade name of Poly (p-phenylene-2,6-benzobisoxazole) (PBO) fibre which is a rigid-rod isotropic crystal polymer. It has a strength and modulus almost double that of some para-aramid fibres. The PBO molecule is generally synthesized by condensing 4,6-diamino-1,3-benzenediol dihydrochloride with terephthalic acid (TA) or a derivative of TA such as terephthaloyl chloride in a poly-phosphoric acid (PPA) solution. "Zylon" is a registered trademark of Toyobo Co. Ltd. in Japan.

In this regard, typical properties for certain materials able to be used are:

| Material | Tensile Strength (MPa) | Density (kg/m$^3$) | Specific Tensile Strength (Nm/kg) |
|---|---|---|---|
| High strength steel | 2000 | 7860 | $0.25 \times 10^6$ |
| Titanium Alloy | 1300 | 4510 | $0.29 \times 10^6$ |
| Steel cord | 3000 | 7860 | $0.38 \times 10^6$ |
| Glass fibre | 3400 | 2600 | $1.3 \times 10^6$ |
| Boron fibre | 3600 | 2540 | $1.4 \times 10^6$ |
| Carbon fibre | 3500 | 1750 | $2.0 \times 10^6$ |
| Vectran | 2900 | 1400 | $2.07 \times 10^6$ |
| Aramid fibre-Technora (Available from Teijin) | 3440 | 1390 | $2.47 \times 10^6$ |
| Aramid fibre-Kevlar (Available from DuPont) | 3600 | 1440 | $2.5 \times 10^6$ |
| High Performance Polyethylene fibre-Dyneema | 2620 | 970 | $2.70 \times 10^6$ |
| Aromatic Heterocyclic Polymer fibre PBO-Zylon ® | 5500 | 1560 | $3.52 \times 10^6$ |
| High Performance Polyethylene fibre-Spectra | 3510 | 970 | $3.62 \times 10^6$ |

The rope generally comprises a plurality of strands, for example being at least 5 or at least 10 strands, optionally in the range of 10-50 strands. Rope formed in strands is well known in the art, and can be contrasted with 'solid' strength members generally formed of a single solid material, or formed of fibres needed to be conjoined by a resin or other adhesive to form a "substantially solid" single entity to provide enough strength.

In another embodiment of the present invention, the tube comprises one or more of the materials of the group comprising: carbon steel, stainless steel, titanium.

Preferably, the tube provides a watertight enclosure to wholly or substantially prevent access of water, in particular seawater, to the rope. Thus, where the properties of the rope could be affected by the presence of water, in particular seawater, the use of an enclosing tube according to the present invention provides the further benefit of overcoming such problems. In particular, if the rope could be affected by one or more of: aging, fatigue resistance, temperature resistance and/or corrosion resistance, the use of an enclosing tube around the rope minimises and optimally prevents any such degradation of the properties of the rope, thereby increasing the reliability of the rope which is not open or otherwise available to inspection once installed and/or in use.

The term "strength to weight ratio" as used herein relates to the specific tensile strength which is also equal to ratio between the tensile strength and the density.

The term "tensile strength" as used herein is defined as the ultimate tensile strength of a material or component, which is maximum tensile force that the material or component can withstand without breaking.

The term "fatigue resistance" as used herein relates to the resistance to repeated application of a cycle of stress to a material or component which can involve one or more factors including amplitude, average severity, rate of cyclic stress and temperature effect, generally to the upper limit of a range of stress that the material or component can withstand indefinitely.

The term "temperature resistance" as used herein relates to the ability of the strength member to withstand changes in its temperature environment. For example, they can be significantly higher temperatures near to the topside of a riser umbilical inside a hot I-tube or J-tube.

The term "corrosion resistance" as used herein relates to the resistance to decomposition of the strength member following interaction with water. The term "corrosion" is applied to both metallic and non-metallic materials. The hydrolysis ageing of polymeric materials is considered as corrosion phenomenon.

According to another embodiment of the present invention, the or each strength member of the present invention is wound helically or in a S/Z pattern along the umbilical. More preferably, the or each such strength member has a constant or S/Z pattern winding along the umbilical, in particular a constant pitch or turn or wind, which allows use of the same spiralling equipment or machine to wind the whole length of the longitudinal strength member along the length of the umbilical.

Generally, the present invention involves providing an umbilical having both a high tensile strength and a high compressive strength. For example, the topside or surface end connection of umbilicals such as dynamic risers, which generally involve a combination of high tension and bending (which can lead to rapid fatigue damage), can be provided with higher tensile and compressive strengths based on the present invention, to increase the strength and fatigue resistance of that part or end of the umbilical, without increasing the overall weight and cost of the remaining length.

With the embodiment of having such strength members, the present invention can provide an umbilical for use at a depth of greater than 2000 m, preferably going to 3000 m and beyond.

The umbilical of the present invention may further comprise one or more other longitudinal strength members, including known strength members.

According to a second aspect of the present invention, there is provided a method of manufacturing an umbilical as hereinbefore defined comprising enclosing a rope in a tube, and locating the tube in the umbilical.

The rope could be enclosed in a tube using one or more known methods such as folding a strip around the tube in order to form a tube, optionally followed by seam welding at the junction area, or by extrusion, by one or more other methods known in the art.

For example, in a first step, a metal strip is longitudinally folded around the rope in order to form a tube. There may be a small overlap at the junction between both sides of the folded strip. A second step consists in seam welding the folded strip at the junction/overlap area. The most suitable welding technique is laser welding (reduced heat affected zone, low risk of overheating the cable during the welding process).

A third possible step is reducing the tube diameter in order to compress the outer surface of the rope. This step may be carried out by a cold rolling process, where the tube is pulled through a series of suitably spaced and profiled rollers, or a cold drawing process, where the tube is drawn trough a die. The die reduction should be carefully chosen in order to achieve the suitable compressive effect without damaging or excessively elongating the rope. During this step, the external diameter of the rope is slightly reduced, thus achieving a good contact with the surrounding tube.

Preferably, these three steps are carried out in-line to avoid un-wanted stretching of the rope.

The contact between the rope and the surrounding tube can be improved by adding one or more intermediate layers between the tube and the rope or by adding a filler material between the tube and the rope, for example by filling the tube with a suitable material between said second and third steps.

The rope may be enclosed by the tube to provide a single conjoined item, such that there is at least some bonding therebetween. Alternatively, the rope is enclosed but not conjoined with the tube.

The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements from any of the embodiments to describe additional embodiments.

BRIEF DESCRIPTION OF THE DRAWINGS

Embodiments of the present invention will now be described by way of example only, and with reference to the accompanying drawings in which.

DESCRIPTION OF PREFERRED EMBODIMENTS

Figure 1:
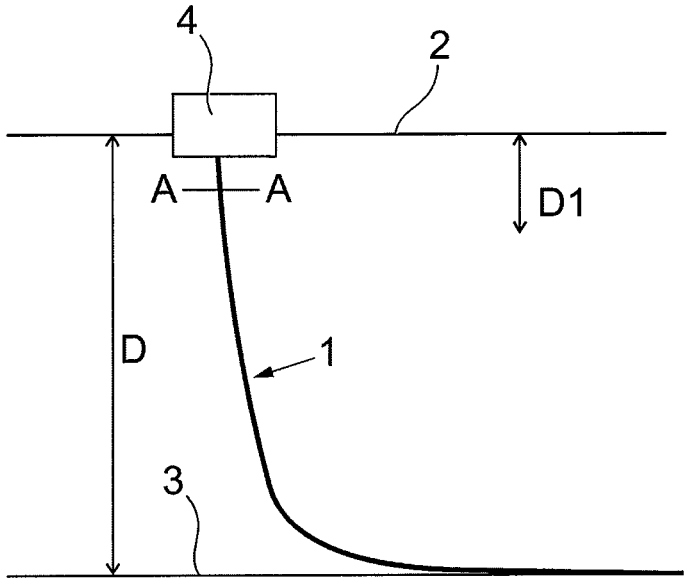
FIG. 1 is a schematic diagram of a first umbilical according to an embodiment of the present invention in a subsea catenary configuration.

Referring to the drawings, FIG. 1 shows a schematic diagram of a first umbilical 1 in catenary configuration between a floating production unit 4 at a sea surface 2, or commonly at the 'topside', and a sea floor 3 or sea bed, with a depth D therebetween.

As is known in the art, the highest tensile and bending stresses are in the top section in the umbilical 1 as it approaches the floating production unit 4, shown in FIG. 1 by the section D1 of depth D. Traditionally, where the depth D is significant (such as >2000 m), load bearing members such as steel rods are provided along the whole length of the umbilical, generally to maintain ease of regular and constant manufacture.

However, whilst such load bearing members assist the tensile and bending stresses in the section D1, they become less useful, and therefor disadvantageous in terms of weight and cost, as the umbilical 1 continues towards the sea floor 3. The longer the umbilical, the greater the disadvantages are.

Furthermore, where the depth D is greater, certainly beyond 2000 m and even 3000 m and beyond, the weight of the heavy copper for the conducting cables further increases the need for stronger reinforcement at or near the floating production unit 4, to withstand the increasing suspended weight and the dynamic installation and operating loads.

Figures 2A, 2B, 2C:
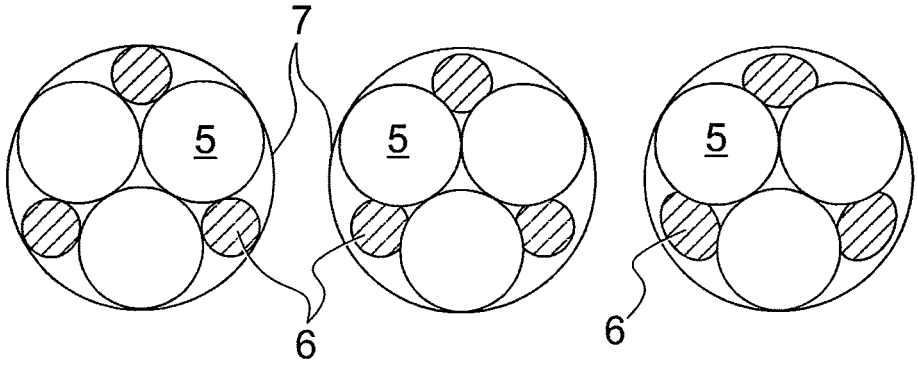
FIGS. 2*a-c* are three cross-sectional views of a prior art umbilical under increasing axial tension.

The simple use of ropes in place of steel rods to provide high tensile strength with reduced weight is possible, but leads to other problems as the umbilical 1 undergoes actual stress. FIG. 2*a* shows a representative prior art umbilical having three power cables 5 and three rope strength members 6 helically wound within a sheath 7. The umbilical in FIG. 2*a* is in an unstressed or unloaded situation such that all the rope strength members 6 have a clear circular cross-section on a prescribed pitch circle (being the distance from the centroid).

However, as shown by FIG. 2*b*, once an axial load is applied to the umbilical, the rope components start to become 'indented', i.e. deforming and moving closer to the centroid (axis) of the bundle of components within the sheath 7, in response to the inward force generated by their helical geometry (i.e., in the form of a stretched helix). During even further loading, the rope components 6 can even become indented and ovalised as shown in FIG. 2*c*. As these rope components change shape, their tensile strength reduces, which is naturally detrimental to the expected overall strength of the umbilical.

During installation of such umbilicals, especially demanding installation with increasing umbilical length, the umbilical may also be subjected to significant radial forces from tensioning devices. Again, the compliance and distribution of load within the cross-section of the strength members is highly significant, and when tensile load is transferred to components by means of frictional contact, the contact forces between the components is critical. As can be seen from a comparison of FIG. 2*a* with either FIG. 2*b* or 2*c*, there is a significant change in the contact forces between the cables 5 and the rope components 6, further altering the maintenance of the umbilical in a desired circular form during and following installation.

Furthermore, some materials that can be used to form high strength ropes are known to be affected by the presence of water, in particular seawater, generally over time. Once an umbilical such as that shown in FIG. 1 is installed, inspection and testing of the strength members is not possible, such that deterioration of the properties of the strength members may be occurring with obvious possible catastrophic consequences.

Thus, the simple use or replacement of ropes leads to certain limits on their exposure to the environment on the grounds of health and safety, which then severally limits or restricts the use of ropes.

Thus, the use of ropes as elongate strength members in umbilicals, especially umbilicals of increasing length (and hence weight), has the problems of trying to constantly maintain a constant circular cross-section, and protecting the rope from the environment.

The present invention overcomes one or more of these problems by the use of a tube surrounding and enclosing the rope to form longitudinal strength members that can extend wholly or substantially along the length of such umbilicals, especially longer/deeper umbilicals. Such tubes can take radial compressive loads, especially during installation of the umbilical, whilst the rope can take axial loads, without being affected by the marine environment. The tube thus maintains the cross-sectional shape of the strength members during loading, especially to meet radial stresses, whilst having the mechanical performance to meet high demands on strength, especially in deep water situations, and the environmental requirements including preventing aging, and fatigue resistance, temperature resistance and corrosion resistance.

Figure 3:
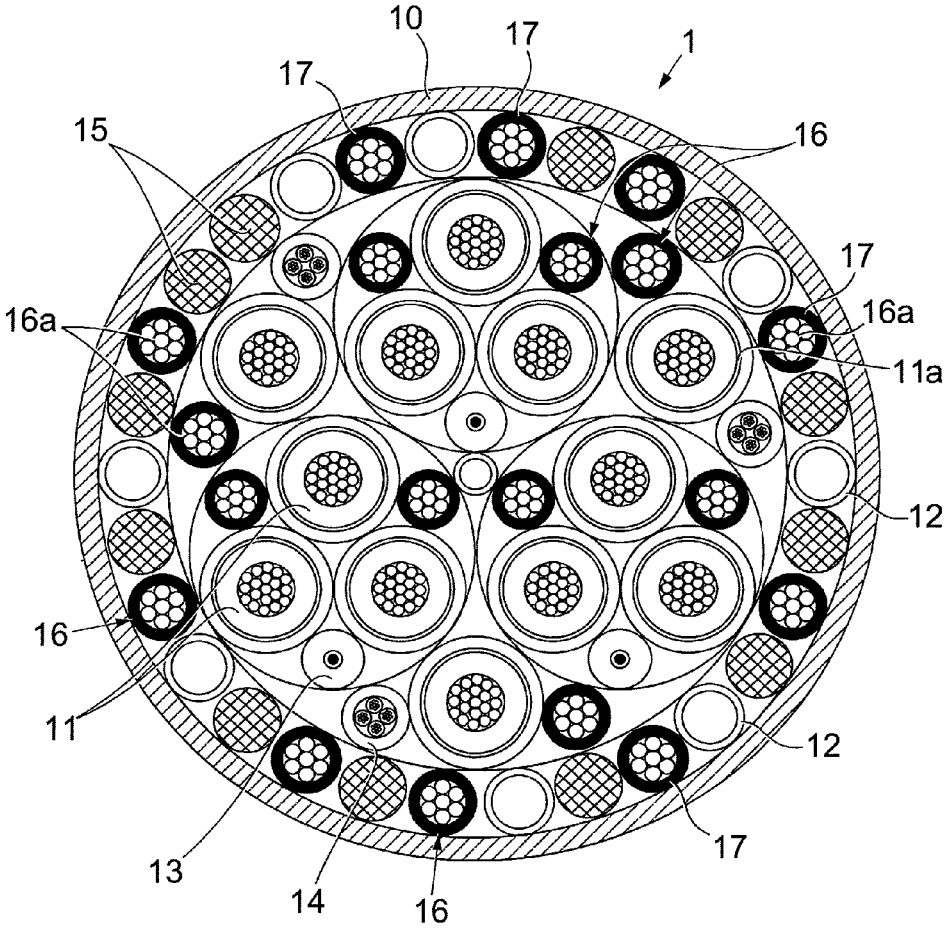
FIG. 3 is a cross-sectional view of the umbilical of FIG. 1 along line AA.

FIG. 3 shows a cross-sectional view of the umbilical 1 of FIG. 1 along line AA. In the example of a power riser umbilical, the umbilical 1 comprises three large power conductors, each having three electrical power cables 11 therein, which, with three other separated power cables 11*a*, makes twelve power cables in all. In addition, there are eight tubes 12, three optical fibre cables 13 and three electrical signal cables 14.

Both within the power conductors mentioned above, and in the surrounding circumferential sections, are a number of steel rope strength members 16, comprising a number of steel strands 16*a* covered by an extruded tube 17 for corrosion and wear protection. These constant strength members 16 extend wholly or substantially the length of the umbilical 1.

In addition, there are a number of polymeric fillers 15 in the umbilical 1 shown in FIG. 3, which again are wholly or substantially constant along the length of the umbilical 1.

Such umbilicals can still be formed with conventional design and manufacture machinery and techniques, preferably by maintaining a constant outer diameter along the length of the umbilical, and preferably by the or each longitudinal strength member in the umbilical also having a constant outer diameter so as to maintain ease of its forming with the other elements of the umbilical in a manner known in the art.

Various modifications and variations to the described embodiments of the invention will be apparent to those skilled in the art without departing from the scope of the invention as defined in the appended claims. Although the invention has been described in connection with specific preferred embodiments, it should be understood that the invention as claimed should not be unduly limited to such specific embodiments.

What is claimed is:

1. An umbilical comprising:

a plurality of longitudinal strength members, at least one longitudinal strength member comprising a rope enclosed within a tube;

the rope made of PBO or other organic materials and has a strength to weight ratio of at least $0.6\times10^6$ Nm/kg; and the tube comprises at least one of the materials of the group comprising: carbon steel and stainless steel, and the tube is watertight.

2. An umbilical as claimed in claim 1, wherein the rope has a tensile strength of at least 2000 MPa.

3. An umbilical as claimed in claim 1, wherein the umbilical comprises a plurality of longitudinal strength members comprising rope enclosed within a tube.

4. An umbilical as claimed in claim 1, configured for use at a depth of greater than 2000 m.

5. An umbilical as claimed in claim 1, further comprising one or more solid longitudinal strength members.

6. An umbilical as claimed in claim 1, wherein the umbilical is a riser.

7. A method of manufacturing an umbilical as defined in claim 1, comprising:

enclosing the rope in the tube; and locating the tube in the umbilical.

8. An umbilical as claimed in claim 1, wherein the umbilical is a power riser.

9. An umbilical as claimed in claim 1, wherein the umbilical is configured for use at a depth of greater than 3000 m.

10. A method of manufacturing as claimed in claim 7, wherein the enclosing the rope in the tube comprises:

forming the tube by folding longitudinally a metal strip around the rope; and then welding at a junction between folded sides of the folded metal strip.

* * * * *